US006966712B2

(12) United States Patent
Trelewicz et al.

(10) Patent No.: US 6,966,712 B2
(45) Date of Patent: Nov. 22, 2005

(54) METHOD AND SYSTEM FOR MINIMIZING THE APPEARANCE OF IMAGE DISTORTION IN A HIGH SPEED INKJET PAPER PRINTING SYSTEM

(75) Inventors: Jennifer Q. Trelewicz, Gilroy, CA (US); Joan L. Mitchell, Longmont, CO (US); Arthur K. Ford, Longmont, CO (US); Carl R. Bildstein, Superior, CO (US); Timothy G. Bradley, Longmont, CO (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/783,581

(22) Filed: Feb. 20, 2004

(65) Prior Publication Data

US 2005/0183603 A1 Aug. 25, 2005

(51) Int. Cl.[7] ..... B41J 11/44
(52) U.S. Cl. ..... 400/76; 400/70; 347/19
(58) Field of Search ..... 101/484; 347/19; 400/76, 70, 61

(56) References Cited

U.S. PATENT DOCUMENTS 4,903,067 A 2/1990 Murayama et al. ..... 346/160
5,452,073 A 9/1995 Kataoka ..... 355/271
5,857,784 A * 1/1999 Allen ..... 400/74
6,022,154 A * 2/2000 Allen ..... 400/76
6,164,847 A * 12/2000 Allen ..... 400/74
6,226,419 B1 * 5/2001 Lodwick et al. ..... 382/294
6,310,637 B1 * 10/2001 Shimada et al. ..... 347/19
6,644,773 B2 * 11/2003 Bildstein et al. ..... 347/19
2002/0063871 A1 * 5/2002 Kinas ..... 358/1.4
2002/0141769 A1 * 10/2002 Phillips ..... 399/38
2003/0174184 A1 * 9/2003 Bildstein et al. ..... 347/19

* cited by examiner

*Primary Examiner*—Minh Chau
(74) *Attorney, Agent, or Firm*—Sawyer Law Group LLP

(57) ABSTRACT

A method and system for a printing device is disclosed. The method and system comprise printing a test pattern on a print medium and generating a digital image of the printed test pattern by an imaging device. The method and system include analyzing an interference pattern to measure for distortion of the print medium and calibrating the printing device based upon the measured distortion.

In a preferred embodiment, the present invention utilizes the reticle patterns, which are printed in the margins of the paper, which are measured real-time during printing. The interference or Moiré patterns created by superimposed reticles may be used to measure image distortion, process direction misalignment, and misregistration caused by web distortion. The advantage of this invention is that image distortion compensation, RIP (Raster Image Processor) parameters, timing, or other printer characteristics may be adjusted on-the-fly in a closed feedback system, for high-speed textile or paper color printing, utilizing on-the-fly distortion or stretch measurement for accurate color and/or duplex images registration. In a duplex printer, automatic images alignment front-to-back is obtained by combining optically or logically the two images for the evaluation of interference patterns and amount of distortion in the process and scan direction.

40 Claims, 5 Drawing Sheets

METHOD AND SYSTEM FOR MINIMIZING THE APPEARANCE OF IMAGE DISTORTION IN A HIGH SPEED INKJET PAPER PRINTING SYSTEM

FIELD OF THE INVENTION

The present invention relates generally to high-speed printing systems and more particularly to a system and method for controlling distortion in a high-speed printing system.

BACKGROUND OF THE INVENTION

In high-speed inkjet systems with high-tension webs, the substrate may experience significant stretching and distortion as a result of the absorption of the ink while the web is under tension. For example, when the web is paper, the distortion and stretching causes noticeable image distortion errors between the color planes of a multi-component system. With some inkjet systems, the resulting image distortion has caused significant customer satisfaction problems, and (along with other significant factors) has led some customers to reserve the printer for one-component printing. Furthermore, drying of the ink during processing causes the paper to shrink, and subsequent component printing causes the paper to stretch again. Stretching may be different in the "scan" direction (i.e., perpendicular to the direction of travel of the web) than in the "process" direction (i.e., the direction of travel of the web) because of the tension in the web. Since the ink content of the components can differ greatly, the degree of stretching or distortion may differ between printing stations.

Conventional inkjet systems have had significant problems with web distortion, which have been addressed mechanically with custom unwinders. The custom unwinder is costly, but its primary shortcoming is that it is not part of a closed-loop system. Specifically, the unwinder does not measure local stretching of the web and adjust its work appropriately.

Furthermore, the unwinder works at only the entry point of the system, so that non-uniform distortion along the process direction cannot be addressed.

Accordingly, what is needed is a system and method for overcoming the above-identified problems. The present invention addresses such a need.

SUMMARY OF THE INVENTION

A method and system for a printing device is disclosed. The method and system comprise printing a test pattern on a print medium and generating a digital image of the printed test pattern by an imaging device. The method and system include analyzing an interference pattern to measure for distortion of the print medium and calibrating the printing device based upon the measured distortion.

In a preferred embodiment, the present invention utilizes the reticle patterns, which are printed in the margins of the paper, which are measured real-time during printing. The interference or Moiré patterns created by superimposed reticles may be used to measure image distortion, process direction misalignment, and misregistration caused by web distortion. The advantage of this invention is that image distortion compensation, RIP (Raster Image Processor) parameters, timing, or other printer characteristics may be adjusted on-the-fly in a closed feedback system, for high-speed textile or paper color printing, utilizing on-the-fly distortion or stretch measurement for accurate color and/or duplex images registration. In a duplex printer, automatic image alignment front-to-back is obtained by combining optically or logically the two images for the evaluation of interference patterns and amount of distortion in the process and scan direction.

DETAILED DESCRIPTION

The present invention relates generally to high-speed printing systems and more particularly to a system and method for controlling distortion in a high-speed printing system. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
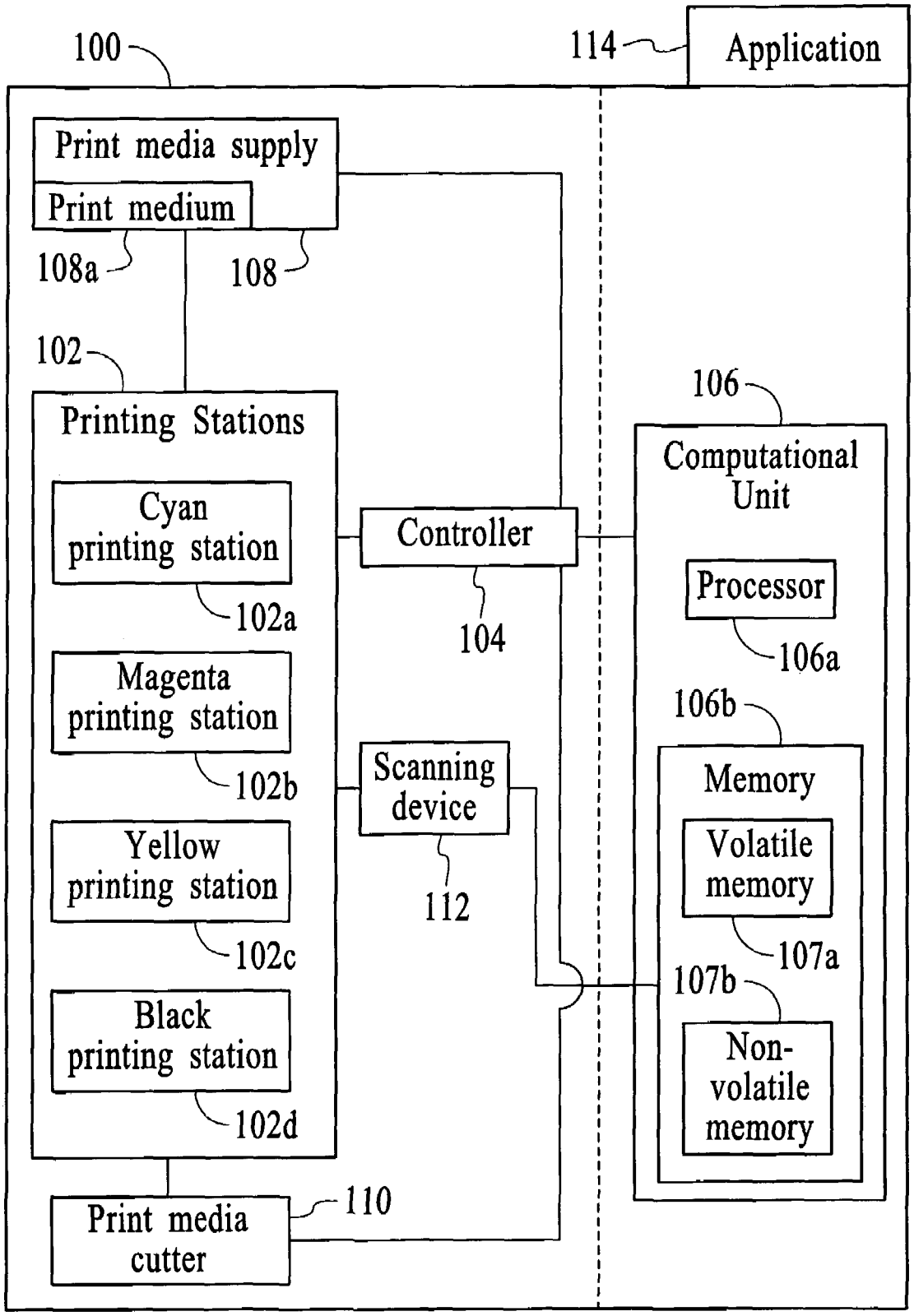
FIG. 1 illustrates a block diagram of a printing environment in which certain described aspects of the invention are implemented.

FIG. 1 illustrates a block diagram of a printing environment in which certain described aspects of the invention are implemented. A printer 100 includes one or more printing stations 102. The printing stations 102 may include a cyan printing station 102*a*, a magenta printing station 102*b*, a yellow printing station 102*c*, and a black printing station 102*d*, capable of printing with cyan, magenta, yellow, and black inks or toners respectively.

The printer 100 may be any multi-component printer known in the art including an electrostatic printer, an inkjet printer, a laser printer, a plotter, a network printer, a stand-alone printer etc. Alternative implements may use other devices that function in a manner analogous to printers such as digital duplicating machines, photocopiers, fax machines etc. While the current implementation describes a four-component printer, in alternative implementations printer 100 could be a two- or three-component printer.

Printer 100 could also be a single component printer, if each of at least two single component printers prints one color component. Also, printer 100 could be a single component printer where the reticle-based method is used for ink jet alignment within the print head.

While FIG. 1 shows four printing stations 102*a*, 102*b*, 102*c*, and 102*d*, there may be fewer or more printing stations in alternative implementations. In some implementations, the black printing station 102*d* may be omitted. The printing stations 102*a*, 102*b*, 102*c*, 102*d* may also print with inks or toners different from cyan, magenta, yellow and black. While the printing stations 102*a*, 102*b*, 102*c*, 102*d* are indicated within separate blocks in FIG. 1 the printing stations 102*a*, 102*b*, 102*c*, 102*d* may be constructed as a single hardware unit or as multiple hardware units. If the printing stations are constructed as a single hardware unit, the single hardware unit may at different times print with a different colored ink or toner.

Printer 100 may also include a controller 104 coupled to a computational unit 106. The computational unit 106 may be any computational unit known in the art, including a processor 106*a* and memory 106*b*. The computational unit 106 may be inside or outside the printer 100. The memory 106*b* may include volatile memory 107*a* such as RAM or non-volatile memory 107*b* such as disk storage. The controller 104 may be implemented in several ways including software, hardware or a combination of software and hardware. The controller 104 may lie within or outside the computational unit 106. In one implementation the controller 104 works cooperatively with the computational unit 106. In some implementations, software or hardware present with or within the printer 100 may absorb the functions of the controller 104.

The controller 104 may be able to calibrate the printing stations 102, a print media supply 108 and a print media cutter 110, and other components of the printer 100 not shown in FIG. 1. The controller 104 may adjust the timing of the firing of the printing stations 102, to compensate for distortion in a printed color plane. The controller 104 may also perform pixel shifts as part of rasterization, i.e. the controller 104 may shift a color plane an integral and/or fractional number of pixels in memory before printing the color plane.

The print media supply 108 may include a collection of any type of print medium 108*a* known in the art on which the printer 100 is capable of printing, including paper, transparencies, fabric, glass, plastic, labels, metal, cardboard, etc. The print medium 108*a* may also be a container made up of a variety of material, including plastic, cardboard, metal etc. In one implementation the print medium 108*a* is a roll of paper. The print medium 108*a* passes through the cyan, magenta, yellow, and black printing stations 102*a*, 102*b*, 102*c*, 102*d*. Subsequently, the print media cutter 110 may crop parts of the print medium 108*a*.

A scanning device 112 is coupled to the printing stations 102 and the computational unit 106. The scanning device 112 may include any scanning device known in the art, including a charge coupled device (CCD) camera, a scanner, or any other imaging device capable of digitizing images printed on the print medium 108*a*. The scanning device 112 can image the print medium 108*a* as the print medium 108*a* moves through the printing stations 102. While FIG. 1 shows only one scanning device, in alternative implementations multiple scanning devices may be positioned to scan the outputs of the cyan, magenta, yellow, and black printing stations 102*a*, 102*b*, 102*c*, 102*d*. In the current implementation, the scanning device 112 scans the print medium 108*a* after the four printing stations 102*a*, 102*b*, 102*c*, 102*d* have printed on the print medium, i.e. a page is scanned after the printer 100 has overlaid all color planes on the page.

An application 114 coupled to the printer 100 may implement aspects of the invention. While the application 114 has been shown in a separate block outside the printer 100, part or all of the functions of the application 114 may be integrated into the computational unit 106, into the controller 104 or into any other unit not illustrated in FIG. 1 such as a printer driver resident on a computational device outside the printer 100.

Figure 2:
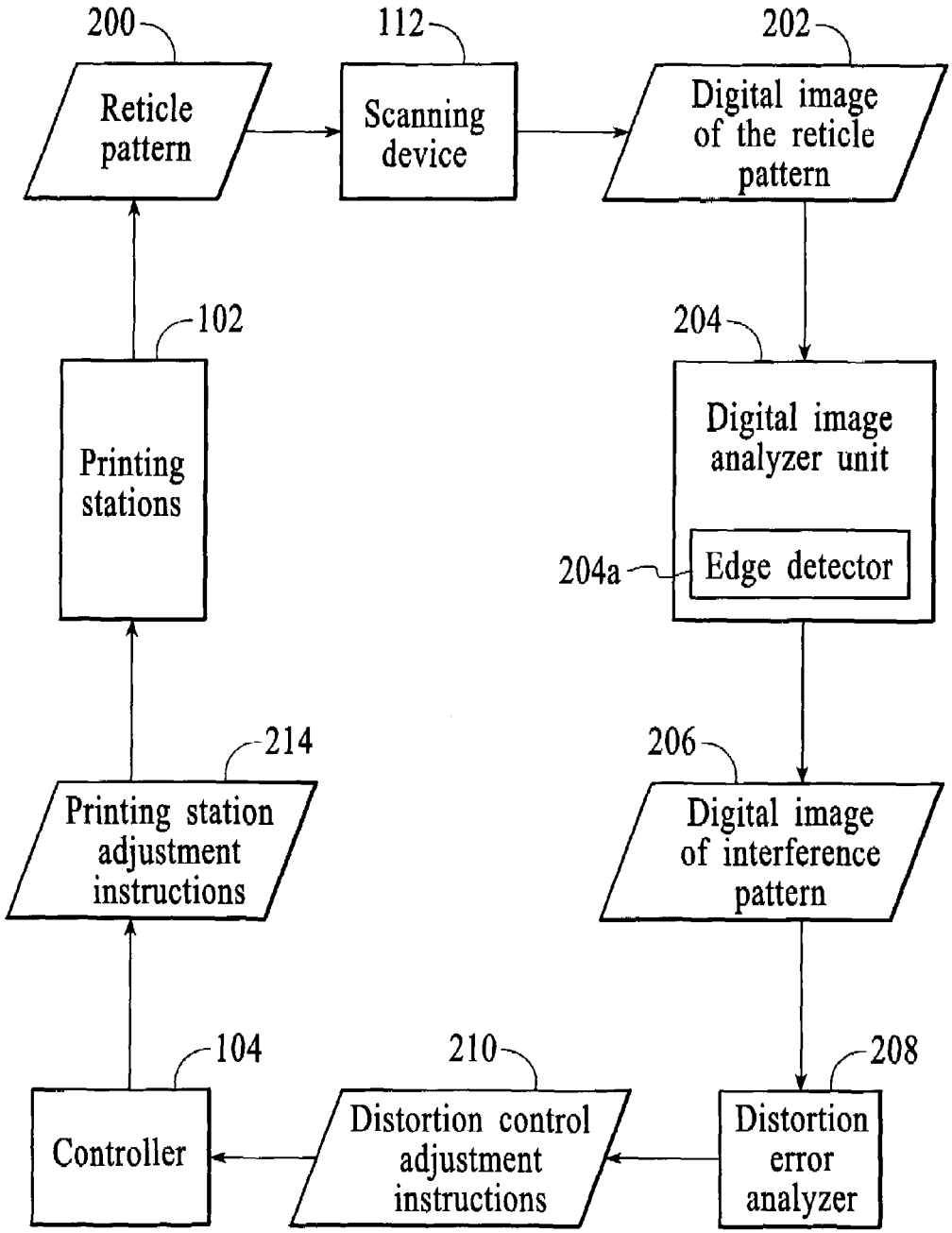
FIG. 2 illustrates a block diagram of software elements, hardware elements, and data structures in which certain described aspects of the invention are implemented.

FIG. 2 illustrates a block diagram of software elements, hardware elements, and data structures in which certain described aspects of the invention are implemented. Referring to FIGS. 1 and 2 together, a reticle pattern 200 is a predetermined marking pattern that is capable of being printed at an appropriate location on the print medium 108*a* by the printing stations 102. Further details of reticle patterns are described in the publication "Reticles in Electro-Optical Devices" (copyright 1966 by Lucien M. Biberman), which publication is herein incorporated by reference.

The scanning device 112 is capable of digitizing the reticle pattern 200 printed on the print medium 108*a* and can produce a digital image of the reticle pattern 202. When the printer 100 prints the reticle pattern 200 onto the print medium 108*a*, if there is color image distortion or reticle image distortion on the printer 100, the printed reticle pattern 200 may have interference patterns, such as Moiré patterns. The test patterns are patterns of light and dark lines, and the interference patterns appear when two repetitive patterns of lines, circles, or arrays of dots overlap with imperfect alignment. Interference patterns magnify differences between two repetitive patterns. If two patterns are exactly lined up, then no interference pattern appears. The misalignment of two patterns will create an easily visible interference pattern. As the misalignment increases, the lines of the interference pattern appear thinner and closer together. Interference patterns are well known in the art and some applications of interference patterns in imaging are described in the doctoral dissertation "Analysis and reduction of Moiré patterns in scanned halftone pictures" (May 1996, Virginia Polytechnic Institute and State University). In the implementation, interference patterns may arise because the printer 100 prints the same reticle pattern 200 by overlaying ink or toner from at least two of the cyan, magenta, yellow, and black printing stations 102*a*, 102*b*, 102*c*, and 102*d* respectively. Interference patterns may appear prominently when reticle patterns have comparable intensity values in the different color planes.

FIG. 2 also illustrates a digital image analyzer unit 204, where the digital image analyzer unit 204 is capable of processing the digital image of the reticle pattern 202 and extracting a digital image of interference pattern 206 corresponding to the digital image of the reticle pattern 202. The digital image analyzer unit 204 may include an edge detector 204*a* that determines edges by applying prior art edge detectors such as the Sobel operator, Canney edge operator or other image gradient-based operators to the digital image of the reticle pattern 202. The digital image analyzer unit 204 and the edge detector 204*a* may be implemented in hardware or software, or via a combination of hardware and software.

A distortion error analyzer 208 is capable of processing the digital image of interference pattern 206 and producing distortion adjustment control instructions 210. Analysis of patterns obtained from reticle patterns is well known in the art and described in the publication "Reticles in Electro-Optical Devices" (copyright 1966 by Lucien M. Biberman). The distortion adjustment control instructions 210 are instructions for adjusting the components of the printer 100, such as the printing stations 102 and the print media supply 108, that reduces the distortion.

The controller 104 may be capable of processing the distortion adjustment control instruction 210, and may produce printing station adjustment instructions 214 to adjust the printing stations 102. The newly adjusted printing stations 102 may print the reticle pattern 200 on the print medium 108*a*.

Figure 3:
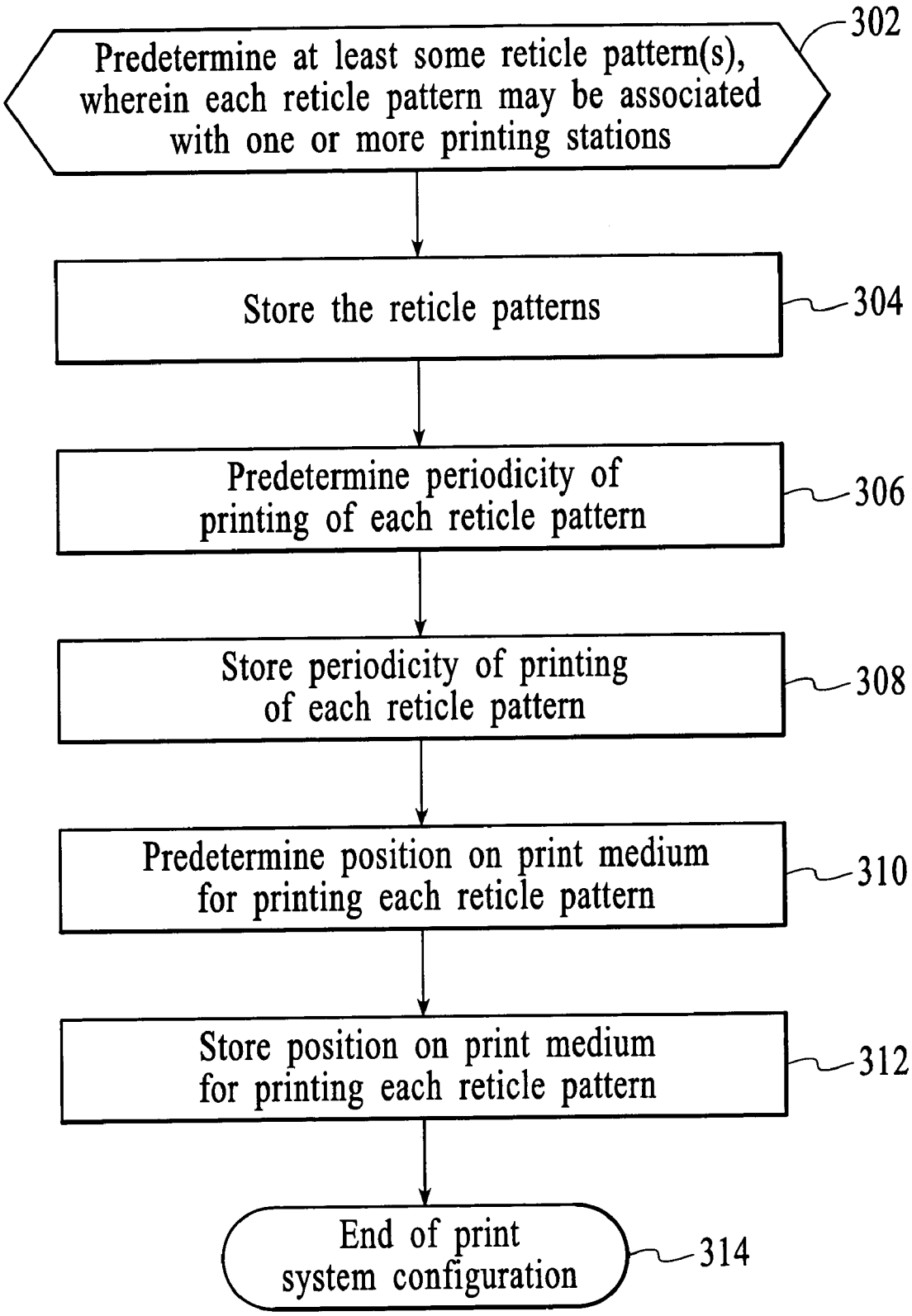
FIG. 3 illustrates logic implemented in an application to configure a print system in accordance with certain described implementations of the invention.

FIG. 3 illustrates logic, implemented in an application 114 of FIG. 1, coupled to the printer 100 to configure the printer 100 in accordance with an implementation of the invention. As stated earlier, the application 114 may reside within the printer 100 or may reside in an external computational device outside of the printer 100 and from the external computational device control the printer 100. Referring to FIGS. 1, 2, and 3 together, at block 302, the application 114 enables an entity (such as an operator, a programmer, a computer program, a predetermined data file etc.) to enter predetermined reticle patterns 200, where each of the reticle patterns 200 may optionally be associated with one or more printing stations 102. The application 114 stores (at block 304) the reticle patterns 200 in the non-volatile memory 107*b*. The application 114 may then enable the entity to enter (at block 306) a predetermined periodicity of printing of each reticle pattern 200. The periodicity of printing of each reticle pattern 200 may depend on how frequently printer 100 has to adjust for distortion. At block 308, the application 114 stores the periodicity of printing of the reticle patterns 200 in the non-volatile memory 107*b*.

The application 114 may then enable the entity to enter (at block 310) the predetermined positions on print medium 108*a* for printing each reticle pattern 200. Control proceeds to block 312, where the printer 100 stores the positions in non-volatile memory 107*b*. Control proceeds to block 314 where the print system configuration ends.

In alternative implementations, the entire logic of FIG. 3 may be preprogrammed such that no entity has to provide any input or predetermine any values. The entire system may come pre-programmed with default reticle patterns, values for periodicity of printing, and positions on print medium for printing each reticle pattern.

Figure 4:
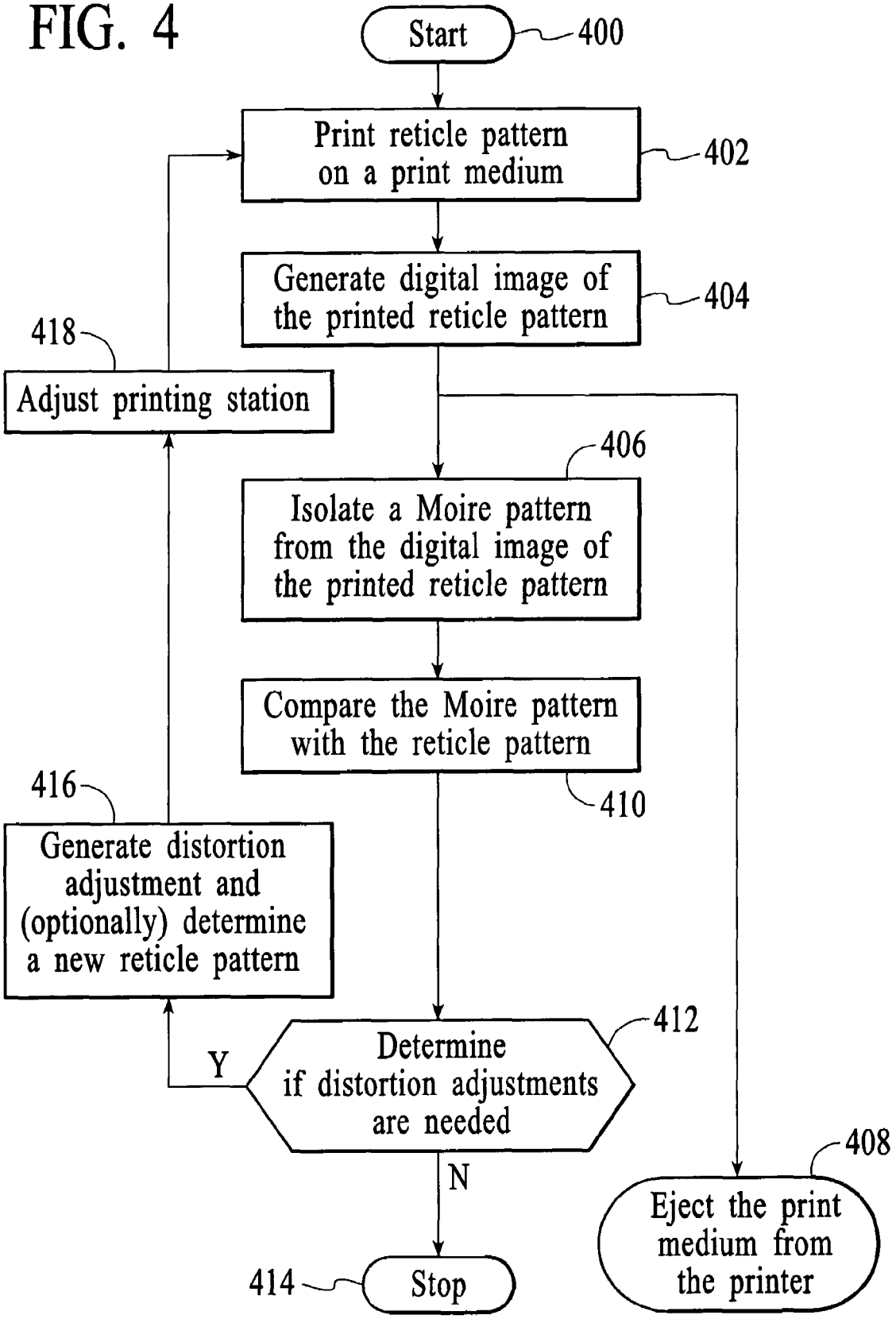
FIG. 4 illustrates logic implemented in an application for color image distortion compensation of a printer in accordance with certain described implementations of the invention.

FIG. 4 illustrates logic implemented in the application 114 of FIG. 1 for minimizing image distortion from the printer 100 in accordance with implementations of the invention, referring to FIG. 1–4 together. The application 114 starts at block 400, and the application 114 prints (at block 402) a reticle pattern 200 on one part of the print medium 108*a* via the printing stations 102. The application 114 may print user requested data on the other parts of the print medium 108*a*. The scanning device 112 scans the digital image and generates (at block 404) a digital image of the reticle pattern 202. At the conclusion of block 404, control passes in parallel to blocks 408 and 406. At block 408, the printer 100 ejects the page. The reticle pattern may be removed by post-processing equipment such as the print media cutter 110. The post processing equipment may process a job much later than the original printing. For example, the printed medium may be re-rolled after printing, stored somewhere, and postprocessed later. In alternate implementations, the reticle pattern may also be removed from the print medium 108*a* without using the print media cutter 110, such as for example by overprinting the reticle pattern with the same color on the print medium, or in any other manner known in the art.

Parallel to the execution of block 408, control proceeds to block 406 from block 404. At block 406, the digital image analyzer unit 204 processes the digital image of the reticle pattern 202 and isolates a digital image of an interference pattern 206. Control proceeds to block 410, where the distortion error analyzer 208 compares the digital image of the interference pattern 206 with the reticle pattern 200. The distortion error analyzer 208 determines (at block 412) if the printer 100 needs to make adjustments to minimize distortion. If no distortion adjustments are needed, control proceeds to block 414 and the process comes to a stop.

If at block 412, the distortion error analyzer 208 determines that distortion adjustments are needed, control proceeds to block 416 where the distortion error analyzer 208 generates distortion adjustment control instructions 210.

Control proceeds to block 418, where the application 114 adjusts the printing stations 102. While the printing stations 102 may be adjusted in several ways, in one implementation the distortion error analyzer 208 sends the distortion adjustment control instructions to the controller 104 and the controller 104 adjusts the printing stations 102 by generating printing station adjustment instructions 214.

Control proceeds to block 402, and a control loop formed by blocks 404, 406*b*, 410, 412, 416, 418 may be repeated. Within the control loop the application 114 repeatedly adjusts the printer 100 until no further distortion adjustments are needed. The application 114 may periodically execute the logic of FIG. 4 depending on how often distortion adjustment is required for the printer 100.

The printer does not have to stop printing during distortion adjustments. For example, with reference to FIG. 4, while the printing station 102 is being adjusted at block 418, the reticle patterns 200 may be ejected (at block 408) from the printer 100. Alternatively, the reticle patterns 200 may be printed in area of the media that may not be visible, may be cropped later or may be part of the desired print area. Additionally, printed media may be rejected until distortion is minimized.

Figure 5:
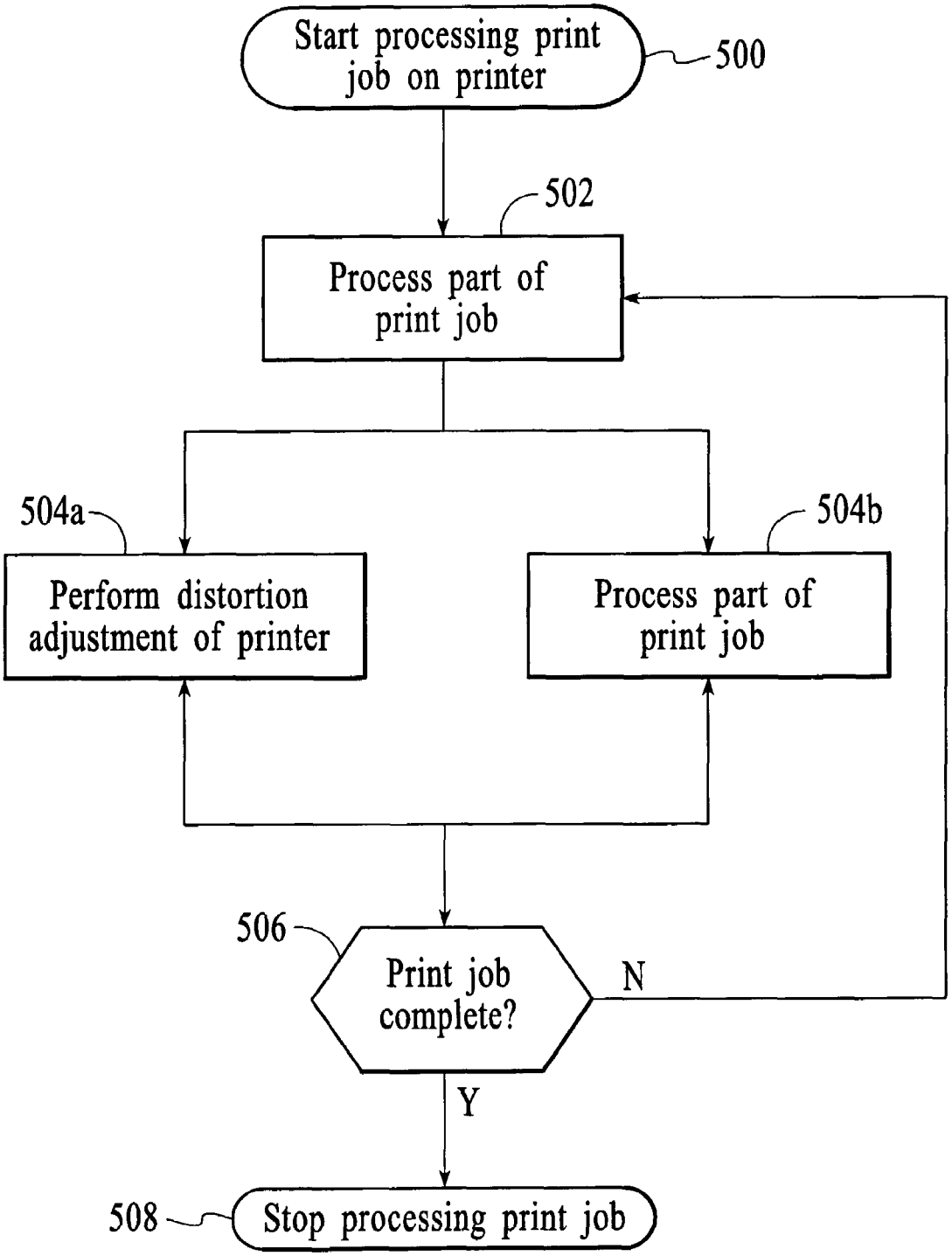
FIG. 5 illustrates logic implemented in an application to indicate how color image distortion compensation of a printer is performed while printing a print job in accordance with certain described implementations of the invention.

FIG. 5 illustrates logic implemented in an application to indicate how distortion adjustment of a printer is performed while printing a print job in accordance with certain implementations of the invention, referring to FIGS. 1 and 5 together. At block 500, the application 114 starts processing a print job. After the application 114 processes (at block 502) part of the print job, the application 114 performs (at block 504*a*) distortion adjustment of the printer and optionally concurrently processes (at block 504*b*) part of the print job. Control proceeds to block 506, at the conclusion of either of blocks 504*a* or 504*b*, where the application 114 determines if the print job is complete. If so, the application 114 stops (at block 508) the processing of the print job. If at block 506, the application 114 determines that the print job is incomplete, control passes to block 502, and the logic of blocks 502, 504*a*, 504*b*, and 506 are repeated.

The method, system, and article of manufacture can perform distortion adjustment on a printer on-the-fly. In this way, the printer is adjusted while printing the print job, such that the distortion measured on a printed page is used to adjust the printer when printing subsequent pages of the print job. Additionally, the periodicity of printing of reticle patterns may be adjusted depending on how frequently printing stations need to be adjusted for distortion. By performing periodic adjustments of the printing station while printing, a printer may print very long print jobs continuously without the intervention of a human operator. The interference patterns provide enough details to adjust the printer to minimize distortion.

ADDITIONAL IMPLEMENTATION DETAILS

The described techniques for distortion adjustment may be implemented as a method, apparatus or article of manufacture using standard programming and/or engineering techniques to produce software, firmware, hardware, or any combination thereof. The term "article of manufacture" as used herein refers to code or logic implemented in hardware logic (e.g., an integrated circuit chip, Programmable Gate Array (PGA), Application Specific Integrated Circuit (ASIC), etc.) or a computer readable medium (e.g., magnetic storage medium, such as hard disk drives, floppy disks, tape), optical storage (e.g., CD-ROMs, optical disks, etc.), volatile and non-volatile memory devices (e.g., EEPROMs, ROMs, PROMs, RAMs, DRAMs, SRAMs, firmware, programmable logic, etc.). Code in the computer readable medium is accessed and executed by a processor. The code in which implementations are made may further be accessible through a transmission media or from a file server over a network. In such cases, the article of manufacture in which the code is implemented may comprise a transmission media, such as a network transmission line, wireless transmission media, signals propagating through space, radio waves, infrared signals, etc. Of course, those skilled in the art will recognize that many modifications may be made to this configuration without departing from the scope of the implementations, and that the article of manufacture may comprise any information bearing medium known in the art.

While the implementations have been described with respect to analysis of interference patterns, such as Moiré patterns, analysis of other patterns similar to interference patterns, or patterns caused via phenomenon or principles similar to interference may also be used. Furthermore, the implementations analyze the interference patterns after all the printing stations have laid down the color planes. In alternative implementations, the scanning device may scan the printed reticle patterns in between printing stations, and secure additional clues for minimizing distortion of the printer. The reticle pattern may also be printed on media to be used for distortion adjustment at a later time and even at a different location.

The implementations of FIGS. 3 and 4 describe specific operations occurring in a particular order. Further, the steps may be performed in parallel as well as sequentially. In alternative embodiments, certain of the logic operations may be performed in a different order, modified or removed and still implement preferred embodiments of the present invention. Morever, steps may be added to the above described logic and still conform to the preferred embodiments.

Variations of the implementations may be constructed for various types of printing devices. For example, in an ink-jet printer the implementation may include reticle patterns that generate interference patterns only if the ink spots printed by an ink-jet printer are small enough not to bleed into each other. In such a case the implementation would attempt to secure interference patterns rather than eliminate interference patterns in the digital image of the reticle pattern. Manual or automatic adjustments may be made to the ink-jet printer, if the spots are judged to be bleeding too much.

Alternatively, the presence of the interference patterns may be used as a security feature on printed materials such as legal documents or currency, where the presence of a correct interference pattern is used to validate the legitimacy of the printed matter. Because only the superimposed reticles, with resulting interference pattern, will be present on the final printed matter, additional security is maintained, since counterfeiters will not have easy access to the original reticle patterns used to create the interference patterns.

In variations of the implementation the calibration may be performed at a later time or at a location different from the printing device. In some printers, a color head on a printing station may comprise of a multiple head array, where each head of the multiple head array may have alignment errors. In one implementation, reticle patterns that cover most of a page may be used to provide diagnostics on each head of the multiple head array. The scanning device may be movable such that the scanning device can be moved over the reticle patterns to return diagnostics as to which heads in the multiple head array are providing the distortion, and to suggest a direction for correction.

The implementation can have a test pattern of interference patterns that cover most of the page to give diagnostics on each of the head arrays. The implementation can have the CCD or scanner that reads the interference patterns be moveable.

The implementation could also include a test pattern of interference patterns, either whole page or across the scan width, so that scan direction distortion of the paper can be measured and adjusted for on a component-by-component basis. The whole pages are used for calibration, where the single-line or-column interference patterns are used for on-the-fly adjustment. Furthermore, rather than a whole "scan line" of interference patterns, one interference pattern can be used at each side (and potentially between pages for n-up configurations) to do coarse measurement of the scan direction distortion, based on the assumption that the distortion is uniform. Since scan direction distortion is going to be less than process direction distortion (because the web is under higher tension in the process direction), the assumption of uniformity is probably sufficient for measurement of scan direction.

A whole scan line of interference patterns can be used to measure and compensate for local changes in distortion; i.e., where distortion is not uniform across the entire scan width, but varies within a print job.

The implementation could allow ink jet printers to have an interference pattern for the test pattern that can indicate if a single jet is out. Interference patterns can be printed in areas where they do not need to be removed, e.g., where they will be hidden by binding or other processing.

In another embodiment, the interference patterns could be used to build a model to assist with on-the-fly or preRIP adjustment. Measured information could be used to develop a model for a closed-loop feedback system for predicting the stretch for this particular paper based on the component coverage (e.g., by pel counting). This can be used to reduce the amount of on-the-fly calculation required.

This model can also be used in preRIP if the paper is known to be the same as the paper used in the model-building run, and if the job coverage/content is known to be comparable to that of the model-building run. This is particularly useful where a job does not need careful image distortion compensation, and where the run performance of the printer is more critical. If content/coverage/paper/environment may have changed "somewhat" from the measurement run, this information in preRIP can be used to bring the print "closer to feedback loop lock" for the on-the-fly adjustment. Model information can be part of the forms definition, for example.

Interference patterns can be used in calibration pages to precalibrate for the paper. Then one may use the prebuilt model to preRIP the data. These interference patterns can be laid out or chosen in such a way to emulate the range of coverage of jobs; e.g., light-to-heavy coverage. They can also be chosen and placed to emulate the actual layout of the non-variable parts of the actual job.

A checksums on overlay projects could be stored, tied to distortion models and form definitions. When the checksum recurs, the distortion model can be pulled up. These stored checksums can be expired out of the database over time if not referenced again, or not stored at all unless the overlay occurs some threshold number of times. For paper with preprinted marks or pinholes, the measured information can be combined with this information to produce a more accurate model. This is also applicable to other printing technology that has not dealt with distortion of the paper, e.g., due to fusing of wet papers on EP technologies.

The present invention could be utilized for applications such as statements, books, or digital newspaper where the image must be registered, but the image distortion of the (usually single-component) text is not important. Thus, only the image is adjusted on-the-fly or pre-adjusted in preRIP, based on the measured or model information.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for a printing device, the method comprising:
printing a test pattern on a print medium;
generating a digital image of the printed test pattern by an imaging device;
analyzing an interference pattern to measure for distortion of the print medium; and
calibrating the printing device based upon the measured distortion.

2. The method of claim 1, wherein the calibration is performed while continuing to process a print job via the printing device, wherein the printing, generating, analyzing, and calibrating are performed repeatedly.

3. The method of claim 1, wherein the calibration is performed at a later time.

4. The method of claim 1, wherein the calibration is performed at a location different from the printing device.

5. The method of claim 1, wherein the interference pattern is at Moiré pattern.

6. The method of claim 1, wherein the printing device is from the group consisting of a multi-component printer, a multi-component photocopier, a multi-component fax machine, a multi-component laser printer, a multi-component electrostatic printer and a multi-component ink-jet printer, wherein the test pattern is a reticle pattern, wherein the print medium is selected from the group consisting of paper, transparency, fabric, plastics, labels, metal, cardboard, and container, wherein the container is selected from the group consisting of plastic, cardboard and metal wherein the imaging device is selected from the group consisting of a scanner of a CCD camera.

7. The method of claim 1, wherein calibrating the printing device further comprises adjusting a timing of a firing of a printing station within the printing device and/or adjusting algorithms to shift pixels during rasterization.

8. The method of claim 1, wherein simultaneously with the printing of the test pattern of the print medium, user data is printed on a same page of the print medium, and further comprising ejecting the print medium from the printing device, wherein the ejecting is performed in parallel to the analyzing and calibrating.

9. The method of claim 1, wherein the test pattern is predetermined, a periodicity of printing of the test pattern is predetermined, a position on the print medium for printing the test pattern is predetermined, the method further comprising:
prior to printing, generating, analyzing, and calibrating:
(i) storing the test pattern;
(ii) storing the periodicity of printing of the test pattern; and
(iii) storing the position on the print medium for printing the test pattern.

10. The method of claim 1, further comprising:
repeatedly calibrating the printing device while the printing device processes a print job, by:
(i) printing the next test pattern on the print medium;
(ii) generating a next digital image of the test pattern by the imaging device;
(iii) analyzing a next interference pattern corresponding to the next digital image; and
(iv) based on the next interference pattern, calibrating the printing device.

11. The method of claim 1, wherein analyzing the interference pattern further comprises:
isolating via edge detection the interference pattern from the digital image;
comparing the interference pattern to the test pattern;
based on the comparison, determining if a calibration of the printing device needs to be performed.

12. The method of claim 1, wherein the printing device has a plurality of printing stations, wherein the test pattern is printed on the print medium by the plurality of printing stations, wherein the printing stations print with at least two components, wherein the components are from the group consisting of ink or toner, and wherein the scanning device generates the digital image of the printed test pattern after the test pattern has been printed at all the printing stations.

13. The method of claim 12 wherein the two components comprise two of black, cyan, and magenta.

14. The method of claim 13, wherein analyzing the interference pattern is performed between printing stations before the printing stations have printed with all colors of the components.

15. The method of claim 1, wherein the printing device is an ink-jet printer, and the interference pattern is caused when a first spot printer by the ink-jet printer does not bleed onto a second spot printed by the ink-jet printer.

16. The method of claim 1, wherein the printing device prints printed matter, wherein the printed matter is selected from the group consisting of a legal document, a currency, or a transferable voucher.

17. The method of claim 1, wherein the printing device comprises a duplex printer, wherein automatic image alignment front to back is obtained by combining the front and back interference patterns and determining the amount of distortion in a process and/or scan direction.

18. The method of claim 1, wherein a color head of the printing device has a multiple head array, wherein test patterns cover a majority of a page of the print medium, wherein the imaging device is moveable, and wherein calibrating the printing device minimizes distortion by changing an alignment of at least one head in the multiple head array.

19. A system for image distortion calibration, the system comprising:
a printing device;
an imaging device coupled to the printing device;
means for printing a test pattern on a print medium by the printing device;
means for generating a digital image of the printed test pattern by the imaging device;
means for analyzing an interference pattern to measure for distortion of the print medium; and means for calibrating the printing device, based on the measured distortion.

20. The system of claim 19, wherein the means for calibrating calibrates the printing device while the printing device continues to process a print job, wherein the means for printing, the means for generating, the means for analyzing and the means for calibrating perform printing, generating, analyzing, and calibrating repeatedly.

21. The system of claim 19, wherein the printing device comprises a duplex printer, wherein automatic image alignment front to back is obtained by combining the front and back interference patterns and determining the amount of distortion in a process and/or scan direction.

22. The system of claim 19, wherein the printing device is from the group consisting of a multi-component printer, a photocopier, a multi-component fax machine, a multi-component laser printer, an multi-component electrostatic printer and an multi-component ink-jet printer, wherein the test pattern is a reticle pattern, wherein the print medium is selected from the group consisting of paper, transparency, fabric, plastics, labels, metal, cardboard, and container, wherein the contain is selected from the group consisting of plastic, cardboard and metal, wherein the imaging device is selected from the group consisting of a scanner and a CCD camera.

23. The system of claim 19, wherein the test pattern is predetermined, a periodicity of printing of the test pattern is predetermined, a position on the print medium for printing and test pattern is predetermined, the system further comprising:

(i) means for storing the test pattern;

(ii) means for storing the periodicity of printing of the test pattern; and (iii) means for storing the position on the print medium for printing the test pattern.

24. The system of claim 19, further comprising:

means for repeatedly calibrating the printing device while the printing device processes a print job, by:

(i) printing the next test pattern on the print medium;

(ii) generating a next digital image of the test pattern by the imaging device;

(iii) analyzing a next interference pattern corresponding to the next digital image; and (iv) based, on the next interference pattern, calibrating the printing device.

25. The system of claim 19, wherein the means for analyzing the interference pattern further performs:

isolating via edge detection of the interference pattern from the digital image;

comparing the interference pattern to the test pattern;

based on the comparison, determining if a calibration of the printing device needs to be performed.

26. The system of claim 19, wherein the printing device has a plurality of printing stations, wherein the test pattern is printed on the print medium by the plurality of printing station, wherein the printing stations print with at least two components, wherein the components are from the group consisting of ink or toner, and wherein the scanning device generates the digital image of the printed test pattern after the test pattern has been printed at all the printing stations.

27. The system of claim 26, wherein the at least two components comprise two of black, cyan, and magenta.

28. An article of manufacture including code for image distortion calibration of a printing device, wherein the code is capable of causing operation, the operations comprising:

printing a test pattern on a print medium;

generating a digital image of the printed test pattern by an imaging device;

analyzing an interference pattern extracted from the digital image to measure distortion of the print medium; and based on the interference pattern, calibrating the printing device.

29. The article of manufacture of claim 28 wherein the calibration is performed while continuing to process a print job via the printing device, wherein the printing, generating, analyzing, and calibrating are performed repeatedly.

30. The article of manufacture of claim 28, wherein the interference pattern is a Moiré pattern.

31. The article of manufacture of claim 28, wherein the printing device is from the group consisting of a multi-component printer, a photocopier, a multi-component fax machine, a multi-component laser printer, an multi-component electrostatic printer and an multi-component ink-jet printer, wherein the test pattern is a reticle pattern, wherein the print medium is selected from the group consisting of paper, transparency, fabric, plastics, labels, metal, cardboard, and container, wherein the container is selected from the group consisting of plastic, cardboard and metal, wherein the imaging device is selected from the group consisting of a scanner of a CCD camera.

32. The article of manufacture of claim 28, wherein simultaneously with the printing of the test pattern on the print medium, user data is printed on a same page of the print medium, and further comprising ejecting the print medium from the printing device, wherein the ejecting is performed in parallel to the analyzing and calibrating.

33. The article of manufacture of claim 28, wherein the test pattern is predetermined, a periodicity of printing of the test pattern is predetermined, a position on the print medium for printing the test pattern is predetermined, the article of manufacture further comprising:

prior to printing, generating, analyzing, and calibrating:

(i) storing the test pattern;

(ii) storing the periodicity of printing of the test pattern; and (iii) storing the position on the print medium for printing the test pattern.

34. The article of manufacture of claim 28, further comprising:

repeatedly calibrating the printing device while the printing device processes a print job, by:

(i) printing the next test pattern on the print medium;

(ii) generating a next digital image of the test pattern by the imaging device;

(iii) analyzing a next interference pattern corresponding to the next digital image; and (iv) based on the next interference pattern, calibrating the printing device.

35. The article of manufacture of claim 28, wherein analyzing the interference pattern further comprises:

isolating via edge detection the interference pattern from the digital image;

comparing the interference pattern to the test pattern;

based on the comparison, determining if a calibration of the printing device needs to be performed.

36. The article of manufacture of claim 28, wherein the printing device has a plurality of printing stations, wherein the test pattern is printed on the print medium by the plurality of printing stations, wherein the printing stations print with at least two components, wherein the components are from the group consisting of ink or toner, and wherein the scanning device generates the digital image of the printed test pattern after the test pattern has been printed at all the printing stations, and wherein analyzing the interference pattern is performed between printing stations before the printing stations have printed with all components colors.

37. The article of manufacture of claim 36, wherein the at least two components comprise two of black, cyan and magenta.

38. The article of manufacture of claim 28, wherein the printing device is an ink-jet printer, and the interference pattern is caused when a first spot printed by the ink-jet printer does not bleed onto a second spot printed by the ink-jet printer.

39. The article of manufacture of claim 28, wherein a color head of the printing device has a multiple head array, wherein test patterns cover a majority of a page of the print medium, wherein the imaging device is moveable, and wherein calibrating the printing device corrects an alignment of at least one head in the multiple head array.

40. The article of manufacture of claim 39, wherein the printing device comprises a duplex printer, wherein automatic image alignment front to back is obtained by combining the front and back interference patterns and determining the amount of distortion in a process and/or scan direction.

* * * * *